US007806679B2

(12) United States Patent
Murata

(10) Patent No.: US 7,806,679 B2
(45) Date of Patent: Oct. 5, 2010

(54) DRAWING APPARATUS AND DRAWING METHOD

(75) Inventor: Shigeoi Murata, Amagasaki (JP)

(73) Assignee: Nihon Spindle Mfg. Co., Ltd., Hyogo (JP)

( * ) Notice: Subject to any disclaimer, the term of this patent is extended or adjusted under 35 U.S.C. 154(b) by 0 days.

(21) Appl. No.: 12/345,989

(22) Filed: Dec. 30, 2008

(65) Prior Publication Data

US 2009/0194900 A1 Aug. 6, 2009

(30) Foreign Application Priority Data

Feb. 6, 2008 (JP) ..... 2008-026448

(51) Int. Cl.
*B28B 3/12* (2006.01)
*B21D 5/06* (2006.01)
*B21D 22/14* (2006.01)

(52) U.S. Cl. ..... 425/374; 425/DIG. 58; 425/402; 425/362; 264/312; 72/82; 72/83; 72/67; 72/112; 72/115

(58) Field of Classification Search ..... 425/238, 425/374, 362, 402, DIG. 58; 264/312; 72/82, 72/83, 67, 112, 115
See application file for complete search history.

(56) References Cited

U.S. PATENT DOCUMENTS 4,533,312 A * 8/1985 Von Holdt ..... 425/438
6,254,256 B1 * 7/2001 Wolfe ..... 362/348
6,526,794 B1 * 3/2003 Langer et al. ..... 72/69

* cited by examiner

*Primary Examiner*—Philip C Tucker
*Assistant Examiner*—Alison Hindenlang
(74) *Attorney, Agent, or Firm*—Wenderoth, Lind & Ponack, L.L.P.

(57) ABSTRACT

A drawing apparatus is capable of releasing a material, the inner surface of which has been formed into a concavo-convex shape with drawing, from a mold with excellent release performance, even in the case where the concavo-convex part formed in the inner surface of the product is of a shape causing it to get caught in the direction of pulling out of the product against the mold. The mold is formed in a split structure having a concavo-convex surface shape and is contractible in diameter after the forming of the material.

19 Claims, 6 Drawing Sheets

DRAWING APPARATUS AND DRAWING METHOD

BACKGROUND OF THE INVENTION

The present invention concerns a drawing apparatus and a drawing method, more specifically, a drawing apparatus and a drawing method which is capable of releasing a material, the inner surface of which has been formed into a concavo-convex shape with drawing, from a mold with excellent release performance.

Conventionally, a method using an electron beam has been used when there is a need to form the inner surface of a product into a concavo-convex shape, such as the vessel of apparatuses for making physical vapor deposition (PVD), chemical vapor deposition (CVD), etc.

SUMMARY OF THE INVENTION

However, the above-mentioned method of using an electron beam has problems such as the necessity of expensive equipment, long working time, and high working cost.

On the other hand, there are press working and drawing, as a general forming method for these types of products, but a problem is that, in the case where an attempt is made to form the inner surface of a product into a desired concavo-convex shape, by means of press working, no sufficient amount of the mass of material flows into the concave part of the mold, thus making it impossible to form the inner surface of the product in desired concavo-convex shape.

Moreover, another problem is that, in the case where the concavo-convex part formed in the inner surface of the product is of a shape causing it to get caught in the direction of pulling out of the product against the mold, forming cannot be accomplished by the method of press working or drawing.

The objective of the present invention, realized in view of the above-described conventional problems in the case of forming of the inner surface of a product into a concavo-convex shape, is to provide a drawing apparatus and a drawing method capable of releasing a material, the inner surface of which has been formed in concavo-convex shape with drawing, from a mold with excellent release performance, even in the case where the concavo-convex part formed in the inner surface of the product is of a shape causing it to get caught in the direction of pulling out of the product against the mold.

To achieve said objective, the drawing apparatus according to the present invention is a drawing apparatus comprising a mold disposed at the tip of a spindle and a squeezing roller for forming a material into a shape along the surface shape of the mold, characterized in that said mold is realized in a split structure having a concavo-convex surface shape and contractible in diameter after the forming of the material.

In this case, it may be possible to construct said mold with split molds formed separately in the circumferential direction and a core portion, and incline the split surfaces at which said split molds come into sliding contact with each other, in the direction of pulling out of the material which has been submitted to drawing.

Furthermore, the drawing method according to the present invention is a drawing method for forming a material, placed on a mold disposed at the tip of the spindle, into a shape along the surface shape of the mold by means of a squeezing roller, characterized in that it uses, as said mold, a mold realized in a split structure having a concavo-convex surface shape and contractible in diameter after the forming of the material, and consists in forming the material placed on the mold, in the state in which the mold is assembled in prescribed shape, into a shape along the surface shape of the mold by means of a squeezing roller, and then contracting the mold in diameter to release the material which has been submitted to drawing from the mold.

In this case, it may be possible to construct said mold with split molds formed separately in the circumferential direction and a core portion, incline the split surfaces at which said split molds get in slide contact with each other, in the direction of pulling out of the material which has been submitted to drawing and, after the forming of the material, cancel the press supporting in radial direction of the split molds by the core, to relatively displace the split molds alternately in the direction of pulling out of the material which has been submitted to drawing.

According to the drawing apparatus and drawing method of the present invention, by forming a material placed on a mold, in the state in which the mold is assembled in prescribed shape, into a shape along the surface shape of the mold by means of a squeezing roller, and then contracting the mold in diameter and releasing the material submitted to drawing from the mold, it becomes possible to release the material the inner surface of which has been formed in a concavo-convex shape by means of drawing from a mold with excellent release performance, even in the case where the concavo-convex part formed in the inner surface of the product is of a shape causing it to get caught in the direction of pulling out of the product against the mold.

More specifically, it becomes possible to release the material, the inner surface of which has been formed into a concavo-convex shape by means of drawing, easily and accurately, without deforming it, after the forming of the material, by cancelling the press supporting in radial direction of the split molds by the core, relatively displacing the split molds alternately in the direction of pulling out of the material which has been submitted to drawing, and contracting the split molds in diameter.

DETAILED DESCRIPTION OF THE INVENTION

Figure 1:
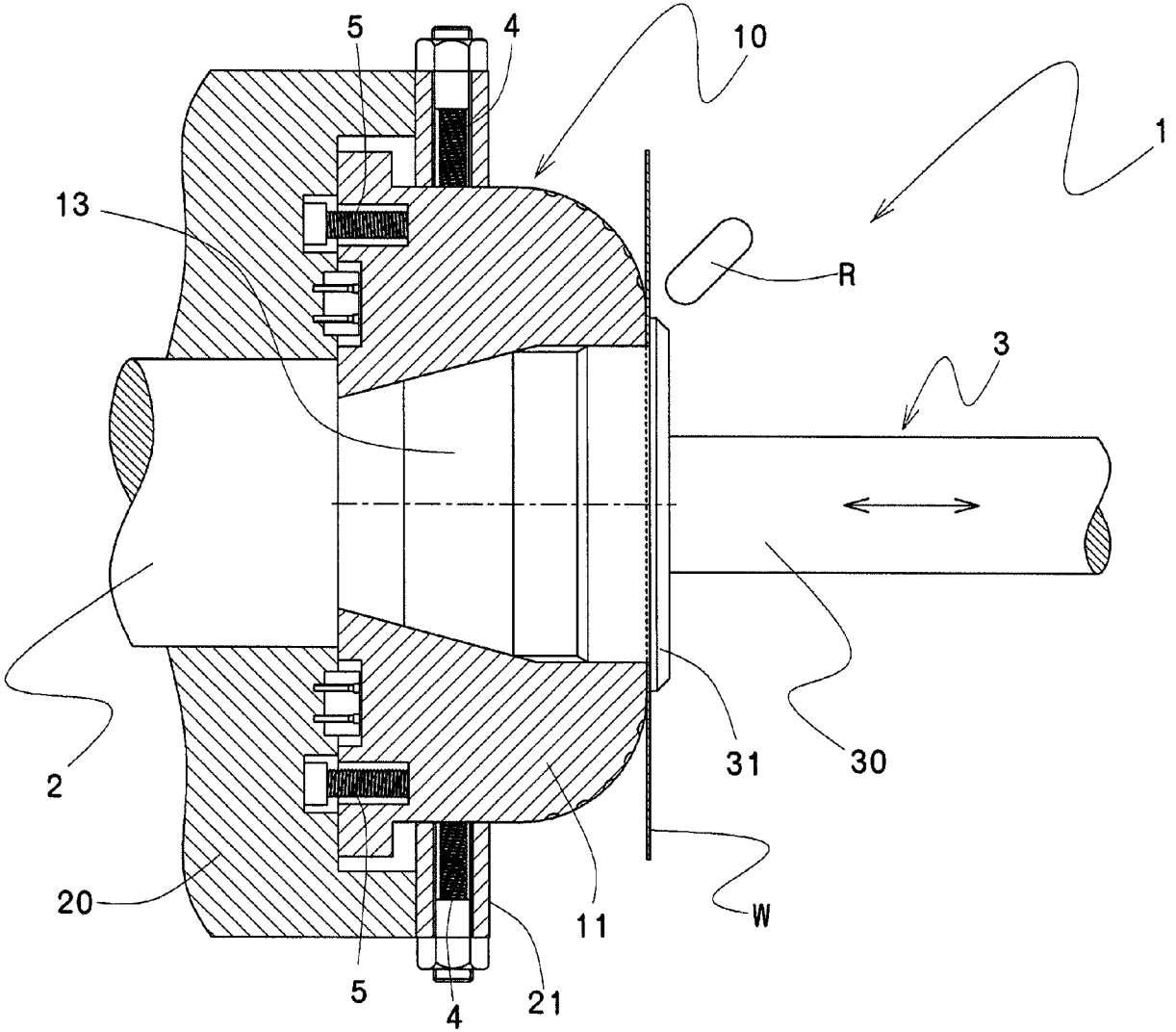
FIG. 1 is a partially omitted front elevation showing a first embodiment of the drawing apparatus according to the present invention.

Embodiments of the drawing apparatus and drawing method according to the present invention will be described below with reference to drawings.

FIG. 1 to FIG. 4 show a first embodiment of the drawing apparatus and drawing method according to the present invention.

The drawing apparatus 1, designed for forming the inner surface of a material into a concavo-convex shape with drawing, includes a mold 10 disposed at the tip of a spindle 2 and a squeezing roller R for forming a material W into a shape along the surface shape of this mold 10, wherein said mold 10 is realized in a split structure having a concavo-convex surface shape and being contractible in diameter after the forming of the material W.

Figure 2:
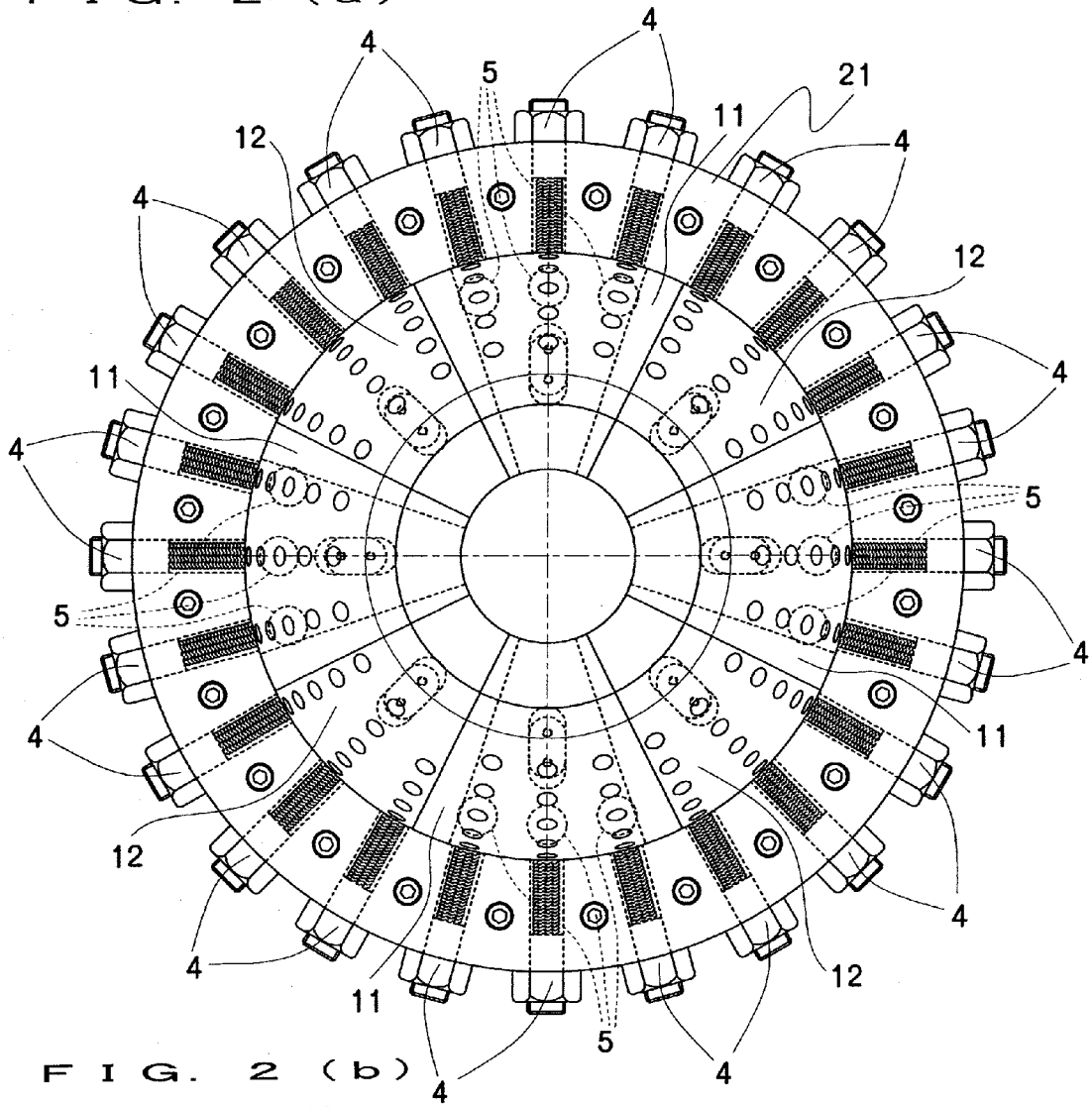
FIG. 2 indicates the mold of the drawing apparatus above, (a) being a front elevation, and (b) a side view.
Figure 2:
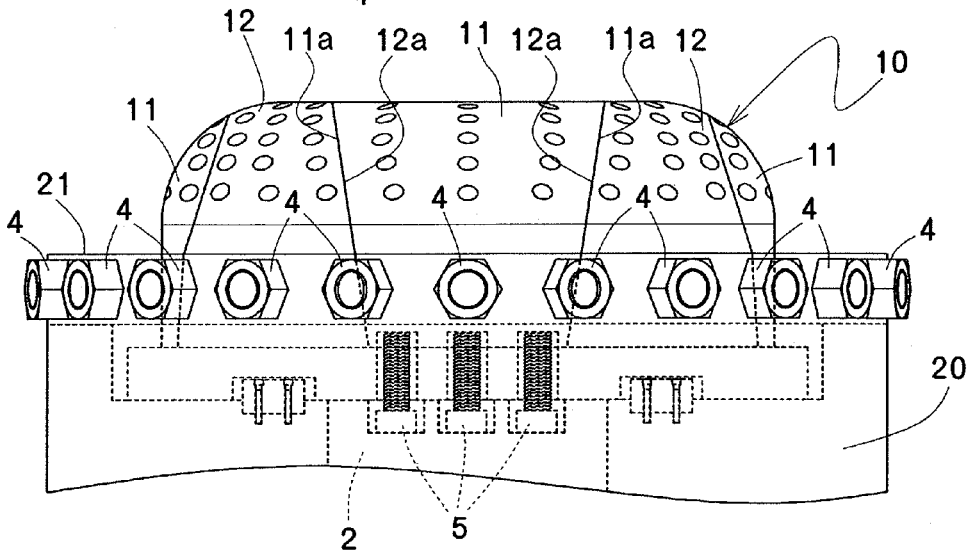

The mold 10, composed of split molds 11, 12 formed separately in the circumferential direction and a core portion 13, is constructed by inclining the split surfaces 11*a*, 12*a* at which the split molds 11, 12 come into sliding contact with each other, in the direction of pulling out of the material W which has been submitted to drawing from the mold 10, as shown in FIG. 2 (*b*), in such a way as to cancel, after the forming of the material W, the press supporting in a radial direction of the split molds 11, 12 by the core 13, relatively displace the split molds 11, 12 alternately in the direction of pulling out of the material W which has been submitted to drawing, and contract the split molds 11, 12, namely the entire mold 10, in diameter.

The shape of the state in which the mold 10 is assembled with the split molds 11, 12 and the core portion 13 is not particularly restricted, and its corner part may be worked in the shape of a circular arc in sectional view, as shown in FIG. 1, or worked as a straight sloped face.

Moreover, the concavo-convex surface shape of the mold 10 is designed to form a large number of concave parts depressed in the shape of dimples on the curved surface of the mold 10, in this embodiment, though it is not particularly restricted either.

The split mold 11 is designed to form split surfaces 11*a*, 11*a* at which it comes into sliding contact with the adjacent split mold 12 in a shape sloped in a way to spread toward the direction of pulling out of the material W, as shown in FIG. 2 (*b*), while on the other hand the split mold 12 is designed to form split surfaces 12*a*, 12*a* at which it comes into sliding contact with the adjacent split mold 11 in a shape sloped opposite to the direction of slope of the split surface 11*a* in a way to face the split surface 11*a*.

Furthermore, the inner surface of the split molds 11, 12 is formed in the shape sloped against the shaft center of the spindle 2 in sectional view so that it may come into sliding contact with the side face of the core portion 13 in the shape of a cone, truncated cone, pyramid or truncated pyramid.

The same number (4 pcs. in this embodiment) of split molds 11 and split molds 12 are combined, to constitute the mold 10 in prescribed shape.

The split molds 11, 12 are pressed in the direction perpendicular to the shaft center of the spindle 2 (direction in which the mold 10 diminishes in diameter), by a presser member 4 incorporated in a ring-shaped presser plate 21 attached to a mold base 20 disposed at the tip of the spindle 2.

Still more, the split mold 11 is pressed in the direction parallel to the shaft center of the spindle 2 (direction of pulling out of the material W), by a presser member 5 attached to the mold base 20.

The presser members 4, 5 are designed, though not particularly restricted, to press the split molds 11, 12 by using a spring, in this embodiment.

Although the direction of pressing by the presser member 5 is given as the direction of pulling out of the material W, in this embodiment, it is also possible to contract the entire mold 10 in diameter by furnishing the split mold 12 with a tensile force in the direction opposite to the direction of pulling out of the material W.

The core portion 13 is not particularly restricted in shape, so long as it can press support the split molds 11, 12 in the radial direction, and may take the shape of a cone, truncated cone, pyramid (octagonal pyramid in the case where the split mold is split into 8 parts) or truncated pyramid and, in this embodiment, it takes the shape of a truncated cone so that its shaft center may agree with the shaft center of the spindle 2 in which the spindle 2 and the split molds 11, 12 are expanded in diameter.

The core portion 13 performs pressing and releasing in radial direction against the split molds 11, 12 by moving in the direction parallel to the shaft center of the spindle 2, causing the split molds 11, 12, jointly with the presser member 4, to make actions of expansion and shrinkage of their diameter.

The moving means of the core portion 13 is constructed, though not particularly restricted, integrally with a chuck 31 for fixing the material W by pressing it against the mold 10, in this embodiment, to move the core portion 13 by means of a tailstock mechanism 3 which makes a tailstock barrel 30, provided with the chuck 31 at its tip, advance or retreat.

Additionally, the core portion 13 may be designed to press support the split molds 11, 12 in the radial direction, by constructing the spindle 2 in a hollow structure and pulling the core portion 13 to the spindle 2 side (left side in FIG. 1).

Next, explanation will be given on the method of drawing made by using this drawing apparatus.

In the first place, press support the split molds 11, 12 in the radial direction, as shown in FIG. 1, by pressing the core portion 13 to the left side in the illustration together with the chuck 31 by means of the tailstock mechanism 3, against the split molds 11, 12 of the mold 10 disposed at the tip of the spindle 2. At that time, the material W is also fixed to the mold 10 by the chuck 31.

Figure 3:
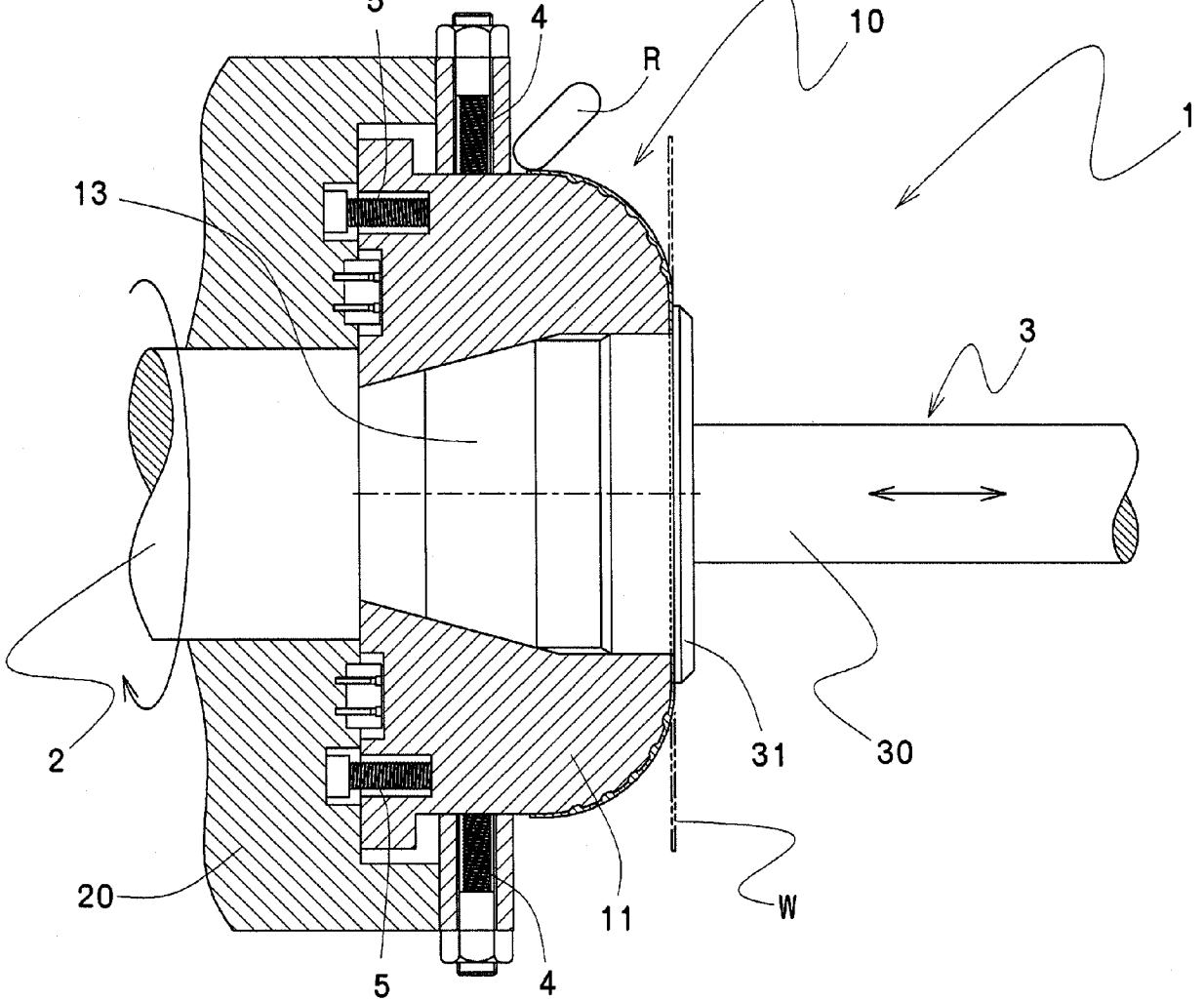
FIG. 3 is a partially omitted front elevation showing the state in which a material was submitted to drawing with the drawing apparatus above.

Next, press the squeezing roller R against the material W fixed to the mold 10, as shown in FIG. 3, while turning the spindle 2 by means of a driving mechanism (not illustrated), and form the material W into a shape along the surface shape of the mold 10.

Next, after forming the material W, cancel the press supporting in radial direction of the split molds 11, 12 by the core portion 13, relatively displace the split molds 11, 12 in the direction of pulling out of the material W which has been submitted to drawing, and contract the split molds 11, 12, namely the entire mold 10, in diameter.

Figure 4:
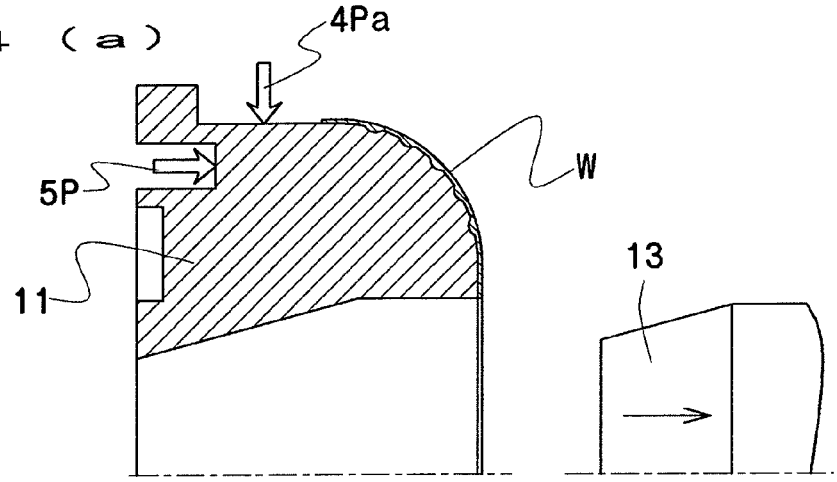
FIG. 4 is an explanatory drawing of the split molds, (a) showing the pressing force acting on the split mold on one side, (b) the pressing force acting on the split mold on the other side, and (c) the state in which the material has been finally released.
Figure 4:
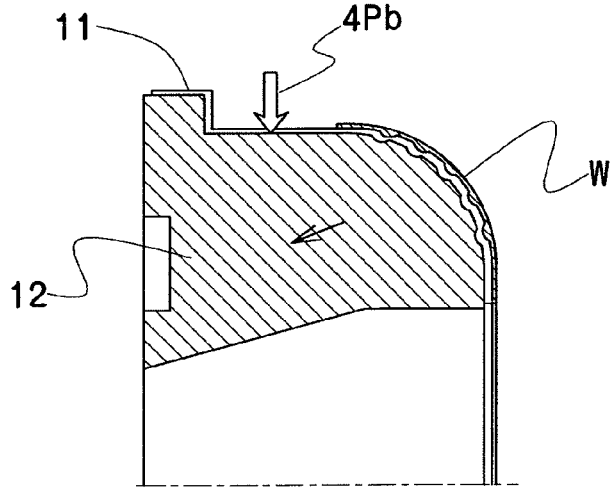
Figure 4:
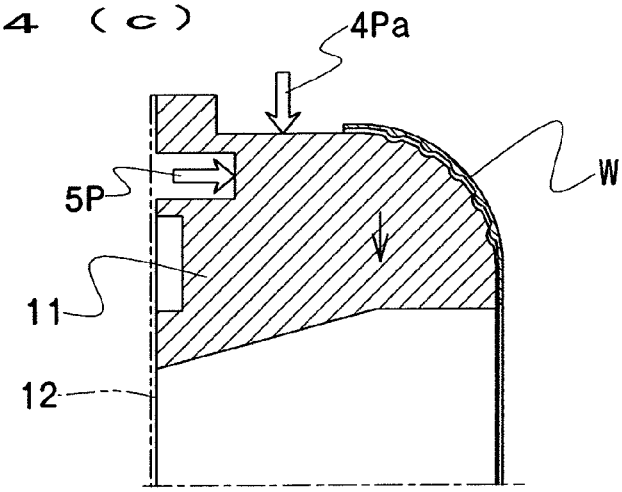

To be more concrete, on the split mold 11, a pressing force 4Pa in the diameter contracting direction by the pressure member 4 and a pressing force 5P in the direction of pulling out of the material W by the pressure member 5 act, as shown in FIG. 4 (*a*) and on the split mold 12, a pressing force 4Pb in the diameter contracting direction by the pressure member 4 acts respectively, as shown in FIG. 4 (*b*), and the split mold 12 moves in the direction of bottom left (inside) in the illustration relatively against the material W, in this embodiment. As a result, the convex portion formed on the inner surface of the material W is released from the concave portion formed on the surface of the split mold 12.

Additonally, the split mold 11, while moving to the right side in the illustration under the pressing force 5P in the direction of pulling out of the material W by the pressure member 5, in linkage with said motion of the split mold 12, diminishes in diameter, together with the split mold 12, under the pressing forces 4Pa, 4Pb in the diameter reducing direction by the pressure member 4, thus enabling the material W to be released from the split mold 11.

Figure 5:
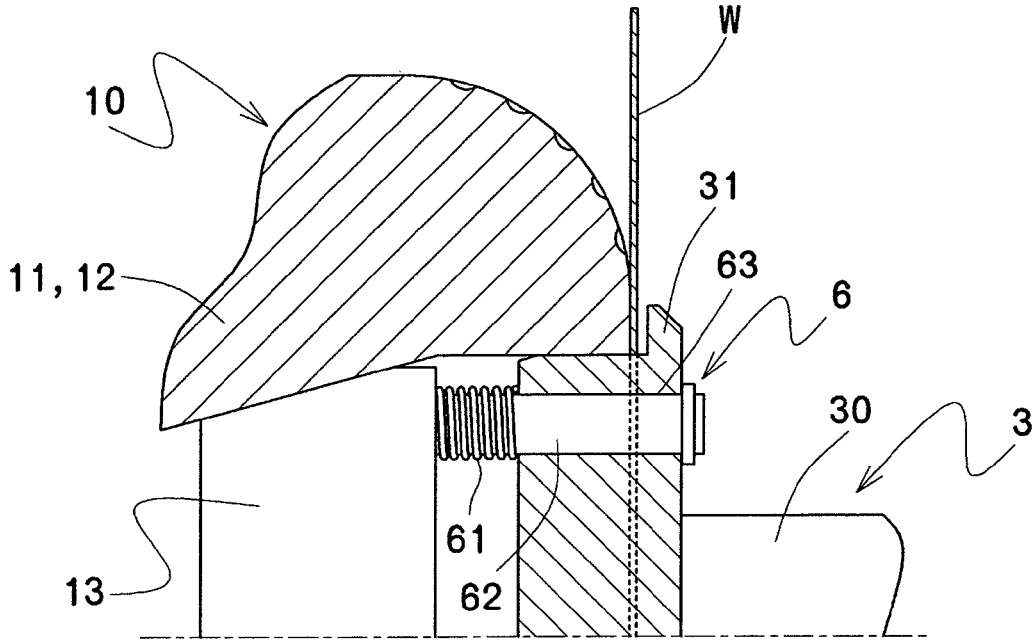
FIG. 5 is a partially omitted front elevation showing a second embodiment of the drawing apparatus according to the present invention, (a) showing a state in which the core press supports the respective split molds in radial direction, and (b) a state in which a chuck press fixes the material.
Figure 5:
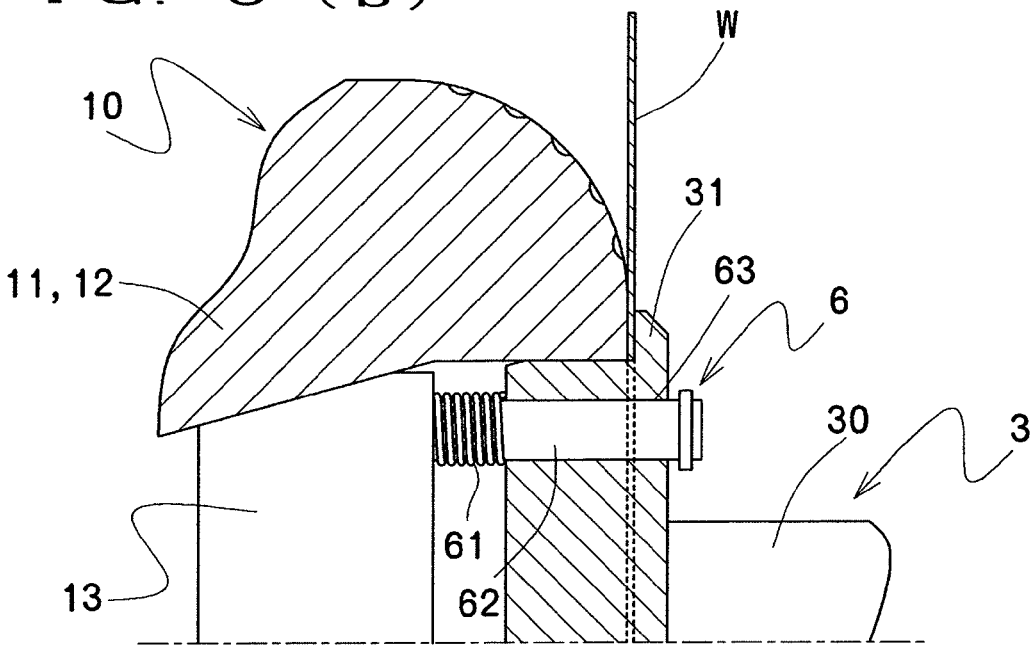

FIG. 5 indicates a second embodiment of the drawing apparatus and drawing method according to the present invention.

This drawing apparatus is identical to that of the first embodiment in the construction of the split molds 11, 12 of the mold 10, and therefore explanation on their construction will be omitted.

The drawing apparatus of this embodiment is realized in a way to connect the core portion 13 with the chuck 31, for pressing the material W against the mold 10, through a buffer mechanism 6, to firmly fix the material W, even in the case where the thickness of the material W is uneven, thus enabling accurate performance of the press supporting in radial direction of the split molds 11, 12 by the core portion 13.

The buffer mechanism 6 may be composed, though not particularly restricted, of a hole portion 63 opened in the chuck 31 fixed to the tip of the tailstock barrel 30 of the tailstock mechanism 3, a shaft portion 62 provided in extension from the core portion 13 sliding in this hole portion 63, and an elastic body 61 consisting of a spring, etc. disposed between the core portion 13 and the chuck 31, as shown in FIG. 5.

According to this drawing apparatus, when the core portion 13 has completed press supporting of the split molds 11, 12 to the left side in the illustration with a pressing force of the tailstock mechanism 3, a gap is produced between the chuck 31 and the material W, as shown in FIG. 5 (*a*).

As the pressing to the left side by the tailstock mechanism 3 is further continued from this state, the elastic body 61 bends, as shown in FIG. 5 (*b*), making it possible to press fix the material W to the mold 10 with the chuck 31.

Figure 6:
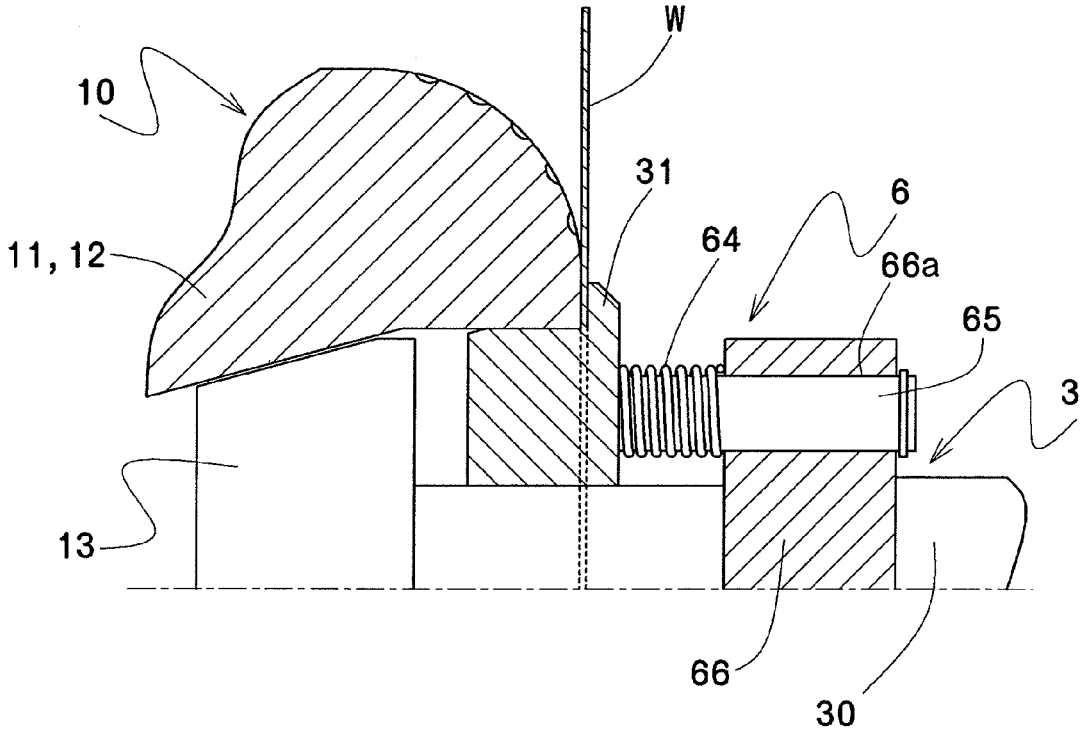
FIG. 6 is a partially omitted front elevation showing other form of the second embodiment above, (a) showing a state in which a chuck press fixes the material, and (b) a state in which the core press supports the respective split molds in radial direction.
Figure 6:
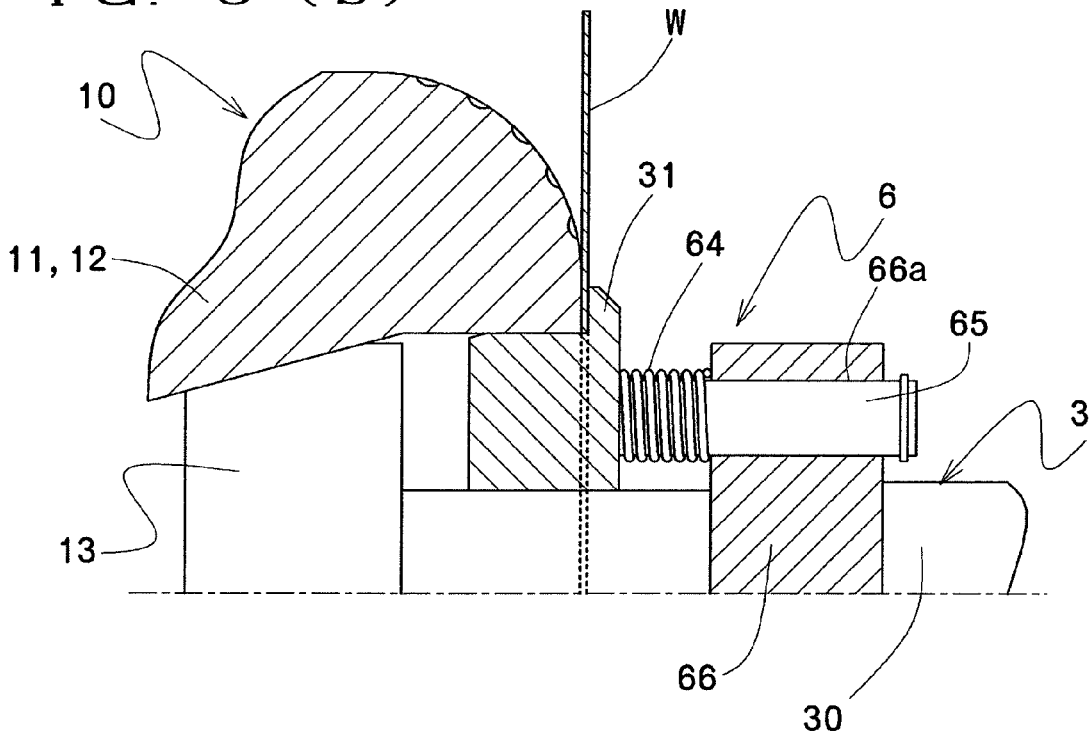

By the way, the buffer mechanism 6 may also be composed, as in a modified embodiment indicated in FIG. 6, of a chuck presser portion 66 formed in protrusion from the tailstock barrel 30 in front of the core portion 13 fixed to the tip of the tailstock barrel 30 of the tailstock mechanism 3, a hole portion 66*a* opened in the chuck presser portion 66, a shaft portion 65 provided in extension from the chuck 31 sliding in this hole portion 66*a*, and an elastic body 64 consisting of a spring, etc. inserted in the shaft portion 65 and disposed between the chuck 31 and the chuck presser portion 66.

According to this drawing apparatus, first the chuck 31 press fixes the material W to the mold 10, with the pressing force to the left side in the illustration by the tailstock mechanism 3, as shown in FIG. 6 (*a*), and, with further pressing to the left side in the illustration by the pressing force of the tailstock mechanism 3, it becomes possible to complete the press supporting in radial direction of the split molds 11, 12 by the core portion 13, as shown in FIG. 6 (*b*).

Other constructions and the procedure and action of the drawing method in this embodiment are the same as those in the first embodiment described above.

Explanation has so far been made of the drawing apparatus and drawing method according to the present invention based on a plurality of embodiments. However, the present invention is not restricted to the constructions described in the above-mentioned embodiments, but may be modified in construction as required within a range not deviating from the main purpose of the invention, such as fixing the spindle, to enable application to a drawing apparatus which performs drawing by disposing a squeezing roller on a rotary shaft, etc.

The drawing apparatus and drawing method according to the present invention have an advantage of being capable of taking out a material, the inner surface of which has been formed into a concavo-convex shape with drawing, from a mold with excellent release performance, even in the case where the concavo-convex part formed in the inner surface of the product is of a shape causing it to get caught in the direction of pulling out of the product against the mold and, for that reason, they can be used widely in the case of forming of the inner surface of a product into a concavo-convex shape.

The invention claimed is:

1. A drawing apparatus comprising:

a spindle;

a mold base disposed at the tip of said spindle;

a mold disposed in said mold base, said mold being formed of a core portion and split molds having a concavo-convex surface shape, said split molds being split from each other along a circumference of said mold, said core portion being operable to press and support said split molds in a radial direction of said mold by sliding contact with inner surfaces of said split molds;

a tailstock barrel for pressing and fixing a material to said split molds;

a squeezing roller for forming the material into a shape along the outer surface of said mold;

a first presser member attached to said mold base for pressing said split molds in a diameter contracting direction of said mold; and a second presser member attached to said mold base for pressing every other split mold in an axial direction of said tailstock barrel, wherein said inner surfaces of said split molds are sloped radially inwardly, and wherein said core portion is formed in a shape for pressing radially outwardly on said sloped inner surfaces of said split molds.

2. The drawing apparatus of claim 1, further comprising:

a buffer mechanism disposed between said core portion and said tailstock barrel; and a chuck disposed on said tailstock barrel for pressing and fixing the material to said split molds.

3. The drawing apparatus of claim 1, wherein said core portion is disposed on said tailstock barrel.

4. The drawing apparatus of claim 1, wherein said core portion is disposed on said tailstock barrel, and said tailstock barrel is movable in the axial direction to press said core portion against said inner surfaces of said split molds.

5. The drawing apparatus of claim 1, wherein said second presser member is attached to every other split mold and acts against the pressing of said core portion such that every other split mold moves in the axial direction of said tailstock barrel when the pressing of said core portion is released.

6. The drawing apparatus of claim 1, wherein said first presser member comprises a plurality of springs which move each split mold in the diameter contracting direction of said mold when the pressing of said core portion is released, and wherein said second presser member comprises a plurality of springs connected to every other split mold, respectively, such that said second presser member moves every other split mold in the axial direction of said tailstock barrel when the pressing of said core portion is released.

7. The drawing apparatus of claim 1, wherein at least a part of said core portion is shaped as one of a cone, a truncated cone, a pyramid, and a truncated pyramid for pressing said inner surfaces of said split molds.

8. A drawing apparatus comprising:

a mold base;

a mold disposed in said mold base for forming a material into a concavo-convex shape by drawing the material on an outer surface of said mold, said mold being formed of a core portion and split molds, said split molds being split from each other along a circumference of said mold, said core portion being operable to press and support said split molds in a radial direction of said mold by sliding contact with inner surfaces of said split molds;

a tailstock barrel for pressing and fixing the material to said split molds;

a squeezing roller for forming the material into the concavo-convex shape along said outer surface of said mold;

a first presser member attached to said mold base for pressing said split molds in a diameter contracting direction of said mold; and a second presser member attached to said mold base for pressing every other split mold in an axial direction of said tailstock barrel, wherein said inner surfaces of said split molds are sloped radially inwardly, and wherein said core portion is formed in a shape for pressing radially outwardly on said sloped inner surfaces of said split molds.

9. The drawing apparatus of claim 8, further comprising a spindle for turning said mold, wherein said mold base is disposed at the tip of said spindle.

10. The drawing apparatus of claim 8, further comprising:

a buffer mechanism disposed between said core portion and said tailstock barrel; and a chuck disposed on said tailstock barrel for pressing and fixing the material to said split molds.

11. The drawing apparatus of claim 8, wherein said core portion is disposed on said tailstock barrel.

12. The drawing apparatus of claim 8, wherein said core portion is disposed on said tailstock barrel, and said tailstock barrel is movable in the axial direction to press said core portion against said inner surfaces of said split molds.

13. The drawing apparatus of claim 8, wherein said second presser member is attached to every other split mold and acts against the pressing of said core portion such that every other split mold moves in the axial direction of said tailstock barrel when the pressing of said core portion is released.

14. The drawing apparatus of claim 8, wherein said first presser member comprises a plurality of springs which move each split mold in the diameter contracting direction of said mold when pressing of said core portion is released, and wherein said second presser member comprises a plurality of springs connected to every other split mold, respectively, such that said second presser member moves every other split mold in the axial direction of said tailstock barrel when pressing of said core portion is released.

15. The drawing apparatus of claim 8, wherein at least a part of said core portion is shaped as one of a cone, a truncated cone, a pyramid, and a truncated pyramid for pressing said inner surfaces of said split molds.

16. A drawing apparatus comprising:

a mold base;

a mold disposed in said mold base for forming a material into a concavo-convex shape by drawing the material on an outer surface of said mold, said mold being formed of a core portion and split molds, said split molds being split from each other along a circumference of said mold, said core portion being operable to press and support said split molds in a radial direction of said mold by sliding contact with inner surfaces of said split molds;

a tailstock barrel connected to said core portion for fixing the material to said split molds, said tailstock barrel being movable in the axial direction to press said core portion against said inner surfaces of said split molds;

a buffer mechanism disposed between said core portion and said tailstock barrel;

a chuck disposed on said tailstock barrel for pressing and fixing the material to said split molds;

a squeezing roller for forming the material into the concavo-convex shape along said outer surface of said mold;

a first presser member attached to said mold base for pressing said split molds in a diameter contracting direction of said mold; and a second presser member attached to said mold base for pressing every other split mold in an axial direction of said tailstock barrel, wherein said inner surfaces of said split molds are sloped radially inwardly, wherein said core portion is formed in a shape for pressing radially outwardly on said sloped inner surfaces of said split molds, and wherein said second presser member is attached to alternate split molds, such that alternate split molds move in the axial direction of said tailstock barrel when pressing of said core portion is released.

17. The drawing apparatus of claim 16, further comprising a spindle for turning said mold, wherein said mold base is disposed at the tip of said spindle.

18. The drawing apparatus of claim 16, wherein said first presser member comprises a plurality of springs which move each split mold in the diameter contracting direction of said mold when pressing of said core portion is released;

wherein said second presser member comprises a plurality of springs connected to every other split mold, respectively, such that said second presser member moves every other split mold in the axial direction of said tailstock barrel when pressing of said core portion is released.

19. The drawing apparatus of claim 16, wherein at least a part of said core portion is shaped as one of a cone, a truncated cone, a pyramid, and a truncated pyramid for pressing said inner surfaces of said split molds.

* * * * *